United States Patent [19]

Brown

[11] 4,025,285

[45] May 24, 1977

[54] PHOTOFLASH LAMP

[75] Inventor: Stephen V. Brown, Winchester, Ky.

[73] Assignee: GTE Sylvania Incorporated, Montoursville, Pa.

[22] Filed: Oct. 28, 1975

[21] Appl. No.: 625,994

[52] U.S. Cl. ..... 431/95 R
[51] Int. Cl.² ..... F21K 5/02
[58] Field of Search ..... 431/95, 93, 94; 149/30, 149/31

[56] References Cited

UNITED STATES PATENTS

| | | | |
|---|---|---|---|
| 3,312,085 | 4/1967 | Schilling et al. | 67/31 |
| 3,685,947 | 8/1972 | Meulemans | 431/95 |
| 3,724,991 | 4/1973 | Schupp | 4 31/95 UX |
| 3,893,798 | 7/1975 | Sterling | 431/95 |

*Primary Examiner*—Edgar W. Geoghegan
*Attorney, Agent, or Firm*—Edward J. Coleman

[57] ABSTRACT

A photoflash lamp having a filament type ignition structure coated with a primer comprising a mixture of combustible metal powder and a binding agent but free of oxidizers.

6 Claims, 1 Drawing Figure

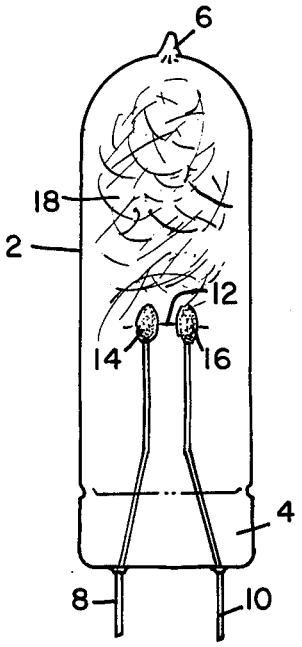
6
18
2
12
14
16
4
8
10

PHOTOFLASH LAMP

BACKGROUND OF THE INVENTION

This invention relates to photoflash lamps and, more particularly, to flashlamps of the type filled with combustible material ignited in a combustion-supporting atmosphere by an electrically conductive filament.

A typical photoflash lamp comprises an hermetically sealed glass envelope containing a quantity of combustible fill material, such as shredded zirconium or hafnium foil, and a combustion-supporting gas, such as oxygen, at a pressure above one atmosphere. In electrically ignitable photoflash lamps, the ignition means typically comprises a pair of lead-in wires sealed through and extending inside one end of the tubular glass envelope. A tungsten filament is mounted across the inner ends of the two lead-in wires with the ends of the wires at their junctions with the filament being coated with a primer material.

Operation of the photoflash lamp is initiated by an electrical current pulse supplied across the external ends of the two lead-in wires. The current flow thorugh the ignition filament causes it to be heated to an elevated temperature. This ohmic heating of the tungsten filament wire conductively heats the beads of primer material contacting the filament wire. When the beads of primer material reach their ignition temperature, they deflagrate and expel burning metal powder throughout the lamp volume. This, in turn, ignites the shredded metallic combustible material, which upon burning generates the actinic output of the lamp.

Throughout the history of photoflash lamps there has been a continuous trend of miniaturization of the lamp envelope. If we look at several photoflash lamps in the order of their development, such as the P-25, M-3, AG-1, FC-1, and HP-1, their internal volumes are 31.0, 7.5, 1.2, 0.62, and 0.78 cc, respectively. With these same lamps, as the volume decreased, the internal $O_2$ pressure increased. Again, in the order of lamp type mentioned, the internal pressures are 53, 95, 360, 500, and 675 cm. Hg., respectively. With the envolution of these lamp types, the primer formulation used was essentially unchanged. This material has basically followed the original composition as disclosed in U.S. Pat. No. 2,280,598, namely, a mixture of zirconium powder (2.5 microns), magnesium powder (325 mesh), potassium perchlorate (reagent grade), and a nitrocellulose binder. This fulminating material is applied to the lead-in wires in the form of a paste. Once dried, this material forms a sensitive coating for ignition of the flash lamp. A typical formulation now used is 83.0% zirconium, 9.8% potassium perchlorate, 4.4% magnesium, and 2.8% nitrocellulose binder resin.

The mechanism of primer ignition is based on the fact that a sensitive mixture of fuel (magnesium and zirconium) is employed with an oxidizer (potassium perchlorate). With the input of electrical energy and subsequent heating of the filament, the fuel begins to ignite. The potassium perchlorate provides oxygen for supporting the combustion of the fuel. Once ignition begins with the release of oxygen from the potassium perchlorate, the reaction commences quickly and rapidly. Burning particles of fuel are distributed throughout the lamp envelope, causing ignition of the zirconium fill. Depending upon the lamp type, peak light intensity occurs anywhere from 12 to 20 milliseconds.

Primer compositions containing reactive fuels, such as zirconium and magnesium powder, together with highly active oxidizers, such as potassium perchlorate, are hazardous materials to prepare and handle in manufacture. When dried such mixtures are susceptible to ignition by friction, heat, or electrostatic discharge. U.S. Pat. No. 3,893,798 describes a primer having a lower ratio of oxidizer to fuel so as to reduce the hazards of handling primer solids in the manufacturing process.

SUMMARY OF THE INVENTION

In view of the foregoing, it is an object of this invention to provide an improved photoflash lamp.

A particular object of the invention is to provide a primer for filament-type photoflash lamps which is safer to prepare and handle in lamp manufacture and which reduces the cost thereof.

These and other objects, advantages and features are attained, in accordance with the principles of this invention by providing a primer material for filament-type flashlamps which does not contain oxidizers but instead derives all the oxygen for combustion from the fill gas of the flashlamp. Preferably, the initial fill gas pressure exceeds about four atmospheres. Surprisingly, this oxidizer-free primer has been found sufficiently sensitive to provide the desired photoflash lamp characteristics, while assuring safer preparation and handling procedures with a resulting reduction in manufacturing cost.

BRIEF DESCRIPTION OF THE DRAWING

This invention will be more fully described hereinafter in conjunction with the accompanying drawing, which is an elevational view of an electrically ignitable photoflash lamp having a filament-type ignition structure with beads of primer material in accordance with the invention.

DESCRIPTION OF PREFERRED EMBODIMENT

Referring to the drawing, the electrically ignitable photoflash lamp illustrated therein comprises an hermetically sealed light-transmitting lamp envelope 2 of glass tubing having a press 4 defining one end thereof and an exhaust tip 6 defining the other ends thereof. Supported by the press 4 is an ignition means comprising a pair of lead-in wires 8 and 10 extending through said sealed into the press. A filament 12 spans the inner ends of the lead-in wires, and beads of primer material 14 and 16 are located on the inner ends of the lead-in wires 8 and 10, respectively, at their junctions with the filament. Typically, the lamp envelope 2 has an internal diameter of less than one-half inch, and an internal volume of less than 1 cc. A quantity of filamentary combustible fill material 18, such as shredded zirconium or hafnium foil, is disposed within the lamp envelope. The envelope 2 is also provided with a filling of combustion supporting gas, such as oxygen for example, at a pressure of several atmospheres. In many applications, the combustible material and the combustion supporting gas are substantially in stoichiometric balance.

In accordance with the present invention, we have discovered, quite unexpectedly, that a sensitive, non-explosive primer for filament-type miniature flashlamps can be provided without the incorporation of any oxidizer whatsoever. Reactive metal powders from the group zirconium, magnesium, hafnium, titanium (or less preferably throium, uranium, lanthanum, yttrium and the rare-earth metals), is mixed with a binding agent such as nitrocellulose in a suitable solvent, for example, amyl acetate. The resultant primer mixture is then applied, such as by a dip process, to form the ignition beads 14 and 16. When dried, the primer exhibits adequate ignition sensitivity in response to activation of the filament. For example, tests have shown no failures occur in subjecting FC-1 lamps (the type used in flashcubes) without oxidizer in the primer to 1.0 ampere for 2.5 milliseconds.

The oxidizer-free primer is dependent upon the compressed oxygen within the miniature flashlamp for combustion. Accordingly, use is preferably restricted to lamps having an oxygen or oxidizing gas fill pressure above about four atmospheres. Further, as is apparent from the above description, when I say the primer is "free of oxidizers", I means that there is no oxidizer component in the primer mixture applied as beads 14 and 16; I am referring to the primer composition independent of permeation by the fill gas.

Operation of the lamp is initiated by low voltage electrical current pulse supplied across the external ends of the two lead-in wires 8 and 10. The current flow through the filament 12 causes it to be heated to an elevated temperature, whereupon the beads of primer material 14 and 16 are heated by conduction from the filament. When the beads of primer material reach their ignition temperature, they deflagrate and expel burning metal powder throughout the lamp volume. This in turn, ignites the shredded metallic combustible 18.

The optimum powdered metal, from the standpoint of cost, availability, and performance, is zirconium. It may be used alone, or together with other metal powders. The use of zirconium together with magnesium may be particularly advantageous. Hafnium is somewhat less desirable because of its high density which causes it to settle very rapidly from suspension. Titanium may be used, but it is less sensitive than zirconium. A number of other metal powders are deemed functional for the oxidizer-free primers described herein, but because they are toxic, costly, rare, or unstable toward air, these metals are less desirable: thorium, uranium, lanthanum, yttrium, and the rare-earth metals.

The binder used may be water- or solvent-soluble. For solvent type primers, nitrocellulose performs well. Other solvent-soluble resins may perform equally well should there be a reason to not use nitrocellulose. A water-soluble resin, hydroxyethyl cellulose, has given oxidizer-free primer performance essentially identical to that of similar cellulose nitrate-based primers. Again many other water-soluble resins would be expected to work as well. The spirit of the invention principle related herein is not associated with or restricted to the choice of particular resinous binders.

The percentage of binding resin in the dried primer may be from 0.5 to 5% by weight, the remainder comprising metal powder. At high binder contents, the ignition sensitivity of the primer is reduced, thereby causing lamp reliability to be significantly diminished. At very low binder contents, the mechanical integrity of the primer suffers so that it can flake or chip off of the lamp ignition structure during shipment and handling.

By way of example only, a primer embodying the inventive principles described herein was prepared using 92.8% zirconium powder, 4.4% magnesium powder, and 2.8% nitrocellulose by weight on a dried basis. The nitrocellulose was dissolved in sufficient amyl acetate so as to give a final primer slurry of about 65% by weight solids, Various combinations of these ingredients can be used. The ratio of zirconium to magnesium can vary from 20:1 to 25:1, with nitrocellulose binder remaining preferably between 2.0% to 3.0% by weight of solids. A group of FC-1 lamps of the construction shown in the drawing were prepared. The lamps were fabricated from type G-1 soft glass tubing of 0.350 inch O.D. The internal volume of 0.63 $cm^3$.; the quantity of filamentary combustible material 18 was 18.5 mgs. of 4 inch long zirconium shreds having a cross section of 0.00093 inch × 0.0012 inch; the oxygen fill pressure was 500 cm. Hg absolute. The lead-in wires 8 and 10 were copper coated dumet, having a diameter of approximately 0.016 inch. The filament comprised a length of tungstenrhenium wire having a diameter of about 0.00013 inch. The ends of the lead-in wires at their junctions with the filament were covered with beads 14 and 16 of the described primer material; about 0.5 mgs. of primer were used for each lamp. Upon flashing these lamps, acceptable photometric characteristics were observed. The following chart illustrates average performance obtained for flashcubes containing these oxidizer-free lamps. Each group consisted of 100 lamps.

| Primer | Peak Time milliseconds | Output 0–25 milliseconds |
|---|---|---|
| Test | 13.9 | 528 zonal lumen seconds |
| Control | 10.2 | 562 zonal lumen seconds |

Even though slightly lower light output was indicated by the test group, the figure shown is well above the nominal value that is accepted, 460 zonal lumens; the nominal value for peak time is 13.0 milliseconds. Even though a slight retardation of peak time occurs, it is not detrimental to lamp performance.

Primer mixtures of this type enhance the safety aspect in preparing and handling this material in lamp manufacture. With no oxidizer is the primer, there is less chance of an explosive type reaction if the mixture ignites inadvertently. By eliminating the oxidizer, the procedures necessary to prepare the oxidizer mixture are also eliminated. Hence, there is a reduction in the preparation time for filament primer, since those safety procedures used in conjunction with addition of oxidizer are eliminated. More specifically, there is approximately a 15% to 20% reduction in cost of preparing materials for filament primer, when there is no requirement for oxidizer.

Thus, oxidizer-free filament primer provides several advantages: there is no less in lamp reliability; lamp photometric performance is acceptable; there is a cost reduction in preparing the primer; and safety of the overall primer preparation procedure is increased.

Although the invention has been described with respect to a specific embodiment it will be appreciated that modifications and changes may be made by those skilled in the art without departing from the true spirit and scope of the invention.

What I claim is:

1. A photoflash lamp comprising:

an hermetically sealed, light-transmitting envelope;

a quantity of combustible fill material located in said envelope;

a combustion-supporting gas in said envelope; and ignition means disposed in said envelope in operative relationship with respect to said combustible fill material, said ignition means including a pair of lead-in wires extending into said envelope, a filament attached to and extending between said lead-in wires within said envelope, and beads of primer material located on the inner ends of said lead-in wires and the junctions between the lead-in wires and the filament, said primer material comprising a particulate fuel and binding agent and being free of oxidizers, whereby said primer is dependent on said gas within the envelope for combustion.

2. The lamp of claim 1 wherein said combustion-supporting gas in said envelope is oxygen at an initial fill pressure exceeding about four atmospheres.

3. The lamp of claim 1 wherein said fuel consists of combustible metal powder.

4. The lamp of claim 3 wherein said primer comprises a mixture of about 97 to 98% combustible metal powder and about 0.5 to 5.0% binding agent, said percentages being by weight on a dried basis.

5. A lamp of claim 4 wherein said combustible metal powder comprises a mixture of zirconium and magnesium, the weight ratio of zirconium to magnesium being in the range of 20:1 to 25:1.

6. The lamp of claim 3 wherein said combustible metal powder includes zirconium, hafnium, titanium and/or magnesium.

* * * * *